US009770665B2

(12) United States Patent
Schwartz et al.

(10) Patent No.: US 9,770,665 B2
(45) Date of Patent: Sep. 26, 2017

(54) FUNCTIONAL MAT RACER

(71) Applicant: Universal City Studios LLC, Universal City, CA (US)

(72) Inventors: Justin Michael Schwartz, Orlando, FL (US); Ross Alan Osterman, Winter Park, FL (US); William Dale Mason, Orlando, FL (US)

(73) Assignee: University City Studios LLC, Universal City, CA (US)

( * ) Notice: Subject to any disclaimer, the term of this patent is extended or adjusted under 35 U.S.C. 154(b) by 0 days.

(21) Appl. No.: 14/704,207

(22) Filed: May 5, 2015

(65) Prior Publication Data

US 2016/0325187 A1 Nov. 10, 2016

(51) Int. Cl.
*A63G 21/18* (2006.01)

(52) U.S. Cl.
CPC ..... *A63G 21/18* (2013.01)

(58) Field of Classification Search
CPC ..... A63G 21/00
See application file for complete search history.

(56) References Cited

U.S. PATENT DOCUMENTS 5,130,693 A * 7/1992 Gigandet ..... G08B 7/06 340/326
5,482,510 A 1/1996 Ishii et al.
6,375,578 B1 4/2002 Briggs et al.
6,540,384 B1 4/2003 Rosevear
7,762,898 B2 * 7/2010 Lunde ..... A63G 21/18 472/116
9,366,404 B1 * 6/2016 Porter ..... F21S 48/00
2006/0094315 A1 5/2006 Brodsky
2007/0087850 A1 4/2007 Henry et al.
2009/0009294 A1 * 1/2009 Kupstas ..... A63G 31/00 340/10.1
2011/0244973 A1 * 10/2011 Brown ..... A63G 31/00 472/118
2012/0275177 A1 * 11/2012 Edmisten ..... A63C 5/06 362/544
2013/0280984 A1 10/2013 Fair et al.
2014/0135137 A1 * 5/2014 Heaven ..... A63G 21/18 472/117
2016/0114240 A1 4/2016 Kim
2016/0136529 A1 * 5/2016 Weston ..... A63G 21/18 472/117
2016/0323969 A1 * 11/2016 Aliakseyeu ..... A63H 33/42

FOREIGN PATENT DOCUMENTS

KR 20130090039 8/2013

OTHER PUBLICATIONS

PCT/US2016/029216 International Search Report and Written Opinion dated Jul. 18, 2016.

* cited by examiner

*Primary Examiner* — Michael Dennis
(74) *Attorney, Agent, or Firm* — Fletcher Yoder, P.C.

(57) ABSTRACT

A functional mat racer in accordance with present embodiments includes a mat configured to accommodate a rider, wherein the mat comprises a ride surface configured to contact a ride floor or slide surface and an opposing surface configured to hold the rider. The functional mat racer also includes one or more handles coupled to the mat and a functional module coupled to the mat, wherein the functional module comprises one or more light sources.

31 Claims, 8 Drawing Sheets

FUNCTIONAL MAT RACER

The present disclosure relates generally to the field of amusement parks. More specifically, embodiments of the present disclosure relate to methods and equipment utilized to provide amusement park experiences.

BACKGROUND

Water parks seek to provide a variety of ride experiences for park visitors, including bumper or raft rides, water slides, log rides, water coasters, and lazy rivers. Water park attractions may be categorized by the presence and/or type of ride vehicle. For example, a children's bumper raft ride may be implemented with a soft inflatable rubber raft, while a water coaster ride may be implemented with metal car or cage-type ride vehicles similar to those in non-water roller coasters and that provide over-the-shoulder harness restraints. Other rides, such as water slides or chutes, may not have any type of vehicle. That is, the park visitors participate in the ride without being enclosed within any type of restraint or vehicle. Such rides may provide enjoyment for the visitors, because visitors sliding down a water chute may have an enhanced sensation of speed relative to a sensation that can be created within a vehicle travelling at similar speeds. However, rides that are implemented with a ride vehicle may have greater opportunities for providing ride immersion effects that operate in conjunction with the ride to advance a ride narrative. For example, a ride vehicle may provide sound or movement effects (e.g., shaking or turning) that are designed to trigger at designated locations within the ride.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a mat racer is provided. The mat racer includes a mat configured to accommodate a rider, wherein the mat comprises a rider surface configured to support the rider and an opposing surface configured to contact a ride floor or slide surface. The mat racer also includes one or more handles coupled to the mat and a functional module coupled to the mat, wherein the functional module comprises one or more light sources.

In accordance with another embodiment, a method is provided. The method includes the step of inserting a first functional module into an opening of a mat racer, wherein the first functional module comprises a first lighting unit comprising one or more light sources and a first power source coupled to the first lighting unit. The method also includes the steps of removing the first functional module from the opening of the mat racer; and inserting a second functional module into the opening of the mat racer, wherein the second functional module comprises a second lighting unit comprising one or more lights and a second power source coupled to second lighting unit.

In accordance with another embodiment, a system is provided. The system includes a plurality of mats configured to accommodate a rider and a plurality of functional modules configured to be interchangeably coupled to the mats, wherein each individual functional module of the plurality of functional modules comprises one or more light sources.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
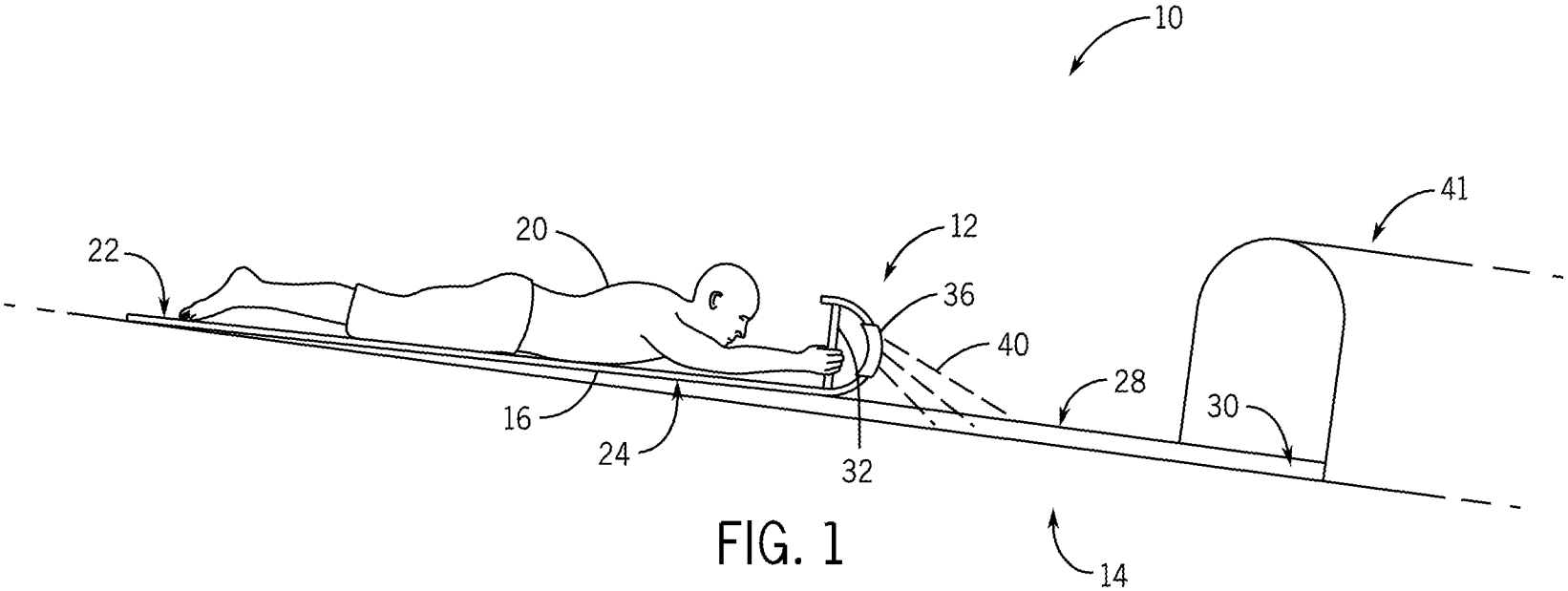
FIG. 1 is a perspective view of a water park attraction including a functional mat racer in accordance with present techniques.

The present disclosure provides functional mat racers that may be used in conjunction with amusement park rides. Water slides and chutes are typically designed for riders to enter legs first, which aligns riders according the turns of the slide and also for legs-first entry into the pool at the end of the ride. However, some water slides or chutes are designed to be used with mat racers, e.g., a structure that permits a rider to slide down in a forward-facing direction. In contrast to a raft or other vehicle, the mat racer is minimally constraining and allows the rider to feel closer to the surface of the slide, which in turn feels faster and more thrilling at relatively lower speeds as compared to vehicle-based rides. In addition, the mat racer may provide a shield that diverts water away from the rider's face, which in turn allows the rider to enjoy the ride with a similar level of immersion relative to a mat-free and legs-first ride.

Provided herein are mat racers with modular and/or integral functional features that are operational during a ride. For example, in one embodiment, a functional mat racer may include a functional module that emits light into the water ahead of the mat to illuminate the immediate area around the mat racer. The lights, particularly in darker sections of the ride, may provide the sensation of gliding on a bed of light. In this manner, the ride experience is enhanced without the addition of features that may introduce rider restraints or that may separate the rider from the surface more than the mat itself. In addition, the lights may be visible to park visitors in the vicinity as the ride is in progress to create additional visual interest. In particular embodiments, the functional features of the mat racer may be activated in a manner independent of the individual features of the ride itself. That is, once the functional module is activated (which may occur as a result of user feedback or a ride activation signal), the various functional features are timed to be activated throughout the ride without additional feedback or activating signals during the ride to affect the operation. In other embodiments, the ride and the mat racer (e.g., a module or integral functional component) may communicate in a one-way or two-way manner to influence the operation of the mat racer. Further, in certain embodiments, the rider may provide input to select the functional features of the functional mat racer.

While the disclosed embodiments are generally described in the context of water rides, water slides, or rides that include a water component, it should be understood that the functional mat racers as provided herein may also be used in other contexts and with non-water based rides. For example, the functional mat racers may be used on slides that do not hold any water. Further, in addition to or instead of water, the functional mat racers may be used in conjunction with rides that feature foam, other liquids, snow, etc. In one example, the functional mat racers disclosed herein may be implemented as snow sleds. Accordingly, the particular construction of the mat (e.g., materials, shape, size) may be implemented according to the desired end use. Yet further, the functional mat racers may be implemented to accommodate a rider in a legs-first or head-first orientation.

FIG. 1 is a perspective view of a water ride system 10 with a functional mat racer 12. In one embodiment, the water ride system 10 may be implemented to facilitate use of the functional mat racer 12 with a water slide 14 or chute 14. The functional mat racer 12 includes a mat 16 that supports a rider 20. The rider 20 generally rests on a rider-supporting surface 22 of the mat 16 while the opposing surface 24 of the mat 16 makes direct contact with one or both of a ride surface 28 (e.g., a surface of a water slide) or the water 30. In this manner, the rider 20 is cushioned against the ride surface 28 while traveling through the ride at increased speeds. The functional mat racer 12 may also include additional features for rider comfort or control, such as one or more handles 32. The mat 16 may be formed from any suitable material, including relatively flexible materials or relatively more rigid materials.

The functional mat racer 12 also includes a functional module 36 that is configured to facilitate functions that enhance the ride experience. In the depicted embodiment, the functional module includes one or more light sources that shine light (depicted by dashed lines 40) into the water 30. In this manner, the path of the ride is lit around the rider 20 as the rider 20 traverses the ride. The interaction of the light 40 and the water 30 may provide pleasing visual effects for the rider 20. For example, the effect of the light 40 may provide the visual impression that the rider 20 is gliding on a surface of light. The lighting may also provide a spectacle for other guests observing (e.g., guests waiting in a queue and observing the rides). The ride may increase this effect by including transparent slide portions, such as a tunnel 41 that refracts the light when the functional mat racer 12 traverse the slide portions. In one embodiment, depending on the light source colors and/or the darkness of the surrounding ride, the light emitted by the functional module 36 may make up most of the available lighting for at least a portion of the ride.

In additional to including light functionality, the functional module 36 may include additional features to enhance a ride experience. In one embodiment, the functional module 36 may include a front-facing and/or rider-facing camera to capture ride still images or video or to provide certain images to the rider 20 for display. Such images may be provided in conjunction with ride experiences. For example, image with certain themes may be provided during certain portions of a ride. In another embodiment, the functional module 36 may include a speaker to play music or other sound effects during the ride. Further, all or some of these functional features may be combined and/or synchronized to enhance the ride experience. For example, a camera may show images of other riders in the ride experiencing a thrilling section further along in the ride while a speaker may play captured audio from those riders to build anticipation.

Figure 2:
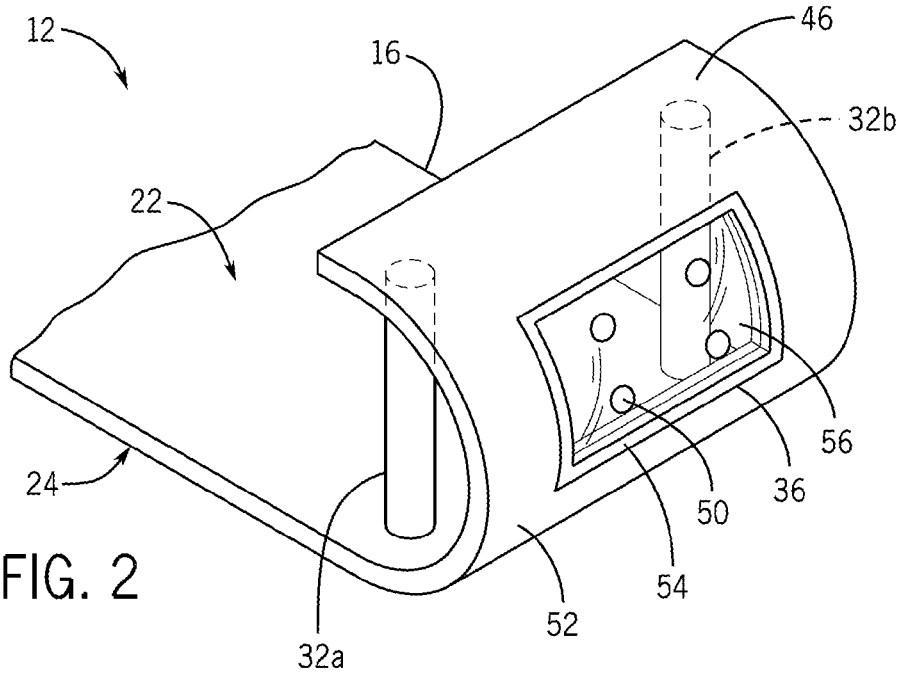
FIG. 2 is a perspective view of an embodiment of a functional mat racer including a front functional module in accordance with present techniques.

FIG. 2 is a perspective view of the functional mat racer 12 depicting an embodiment of the functional module 36 incorporated into a bent or curved front portion 46 of the mat 16. In certain embodiments, the mat racer 12 may be implemented such that the curved front portion 46 is configured as a front shield to protect the rider from water splashing. The functional module 36 may be coupled to or integrated with the mat 16 in the curved front portion 46, e.g., positioned between the handles 32*a*, 32*b*. Because this section is raised relative to the rider-supporting surface 22 (and the opposing surface 24), the functional module 36 may experience less wear and tear or water submersion relative to other positions on the mat 16. Further, the light sources 50 may be positioned to shine out from the mat racer 12 to illuminate a broader area when slightly raised. To that end, the functional module 36 may assume a generally curved shape that follows the curve of the curved front portion 46. The functional module 36 may include any number of light sources 50 on or in the functional module 36. For example, the light sources 50 may be arranged in a row, a column, or an array.

The functional module 36 may be positioned on any suitable portion of the mat 16, depending on the functions included and the desired effects. For example, positioning the functional module towards the bottom 52 of the curved front portion 46 may result in light sources 50 that are more consistently positioned within the water during the ride for a more dramatic light show. In addition, the functional module 36 may be any suitable size or shape, depending on the included features. For example, a relatively simple functional module 36 including only a few light sources 50 may be relatively small and may cover a smaller footprint on the mat racer 12 than a more complex functional module 36 that includes more light sources 50 and/or additional features, such as camera or speaker functionality. In specific embodiments, the functional module 36 may cover 5-75% of a surface area of the curved front portion 46.

Regardless of the positioning of the functional module 36 on the mat 16, the functional module 36 may be configured to contact water during a water ride, at least in part. Accordingly, the functional module 36 may be implemented as a sealed or waterproof unit. To protect the electronic components, such as the light sources 50, the electronic and/or any associated control system components may be sealed within a housing 54 that includes a translucent or clear screen 56 to permit the light from the light sources 50 to pass through and onto the water or ride surfaces. In one embodiment, the housing 54 is formed from a resilient waterproof material that is different from a more compliant or cushioned material forming the mat 16. In other embodiments, the housing 54 may be formed from a relatively complaint waterproof material forming a seal around more resilient interior electronic components. The housing 54 may also be padded at least in part, (e.g., around portions that do not emit light) for the comfort of the rider.

In particular implementations, the functional module 36 may be integrated within the mat 16 as a single structure such that the functional module 36 is not removable by an operator. That is, the functional module 36 may be bonded to, adhered to, or otherwise non-removably coupled to the mat 16. Such an implementation may be advantageous to reduce complexity and storage of the functional mat racers 12, particularly because the mat 16 may be relatively inexpensive to manufacture relative to the functional module 36. However, in certain embodiments, the functional module 36 may be implemented as a removable unit that may be removed from the mat 16 by an operator, e.g., for charging, service, upgrades, etc. Such an implementation may be advantageous to permit charging or service of the functional modules 36 without the need to accommodate the relatively bulky mats.

Figure 3:
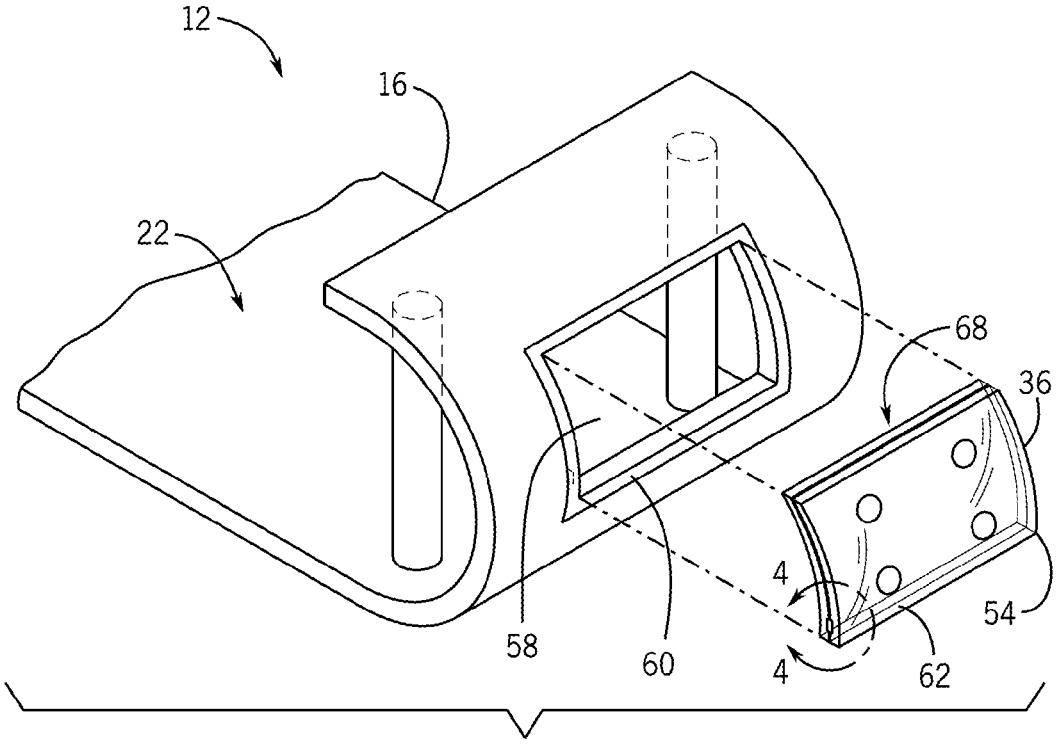
FIG. 3 is a perspective view of the functional mat racer of FIG. 2 with the functional module in the disengaged configuration.

FIG. 3 is a perspective view of an embodiment in which the functional module 36 is removable from the mat. 16. The mat 16 includes a receptacle or opening 58 sized and shaped to accommodate the functional module 36. The opening 58 may be defined by a frame 60 that mates with one or more features on an exterior 62 of the housing 54. The depicted embodiment shows the opening 58 that passes through the mat 16. In such an embodiment, the back surface 68 of the functional module 36 is visible on the rider-supporting surface 22 when inserted into the frame 60. In such an implementation, a rider-facing camera may be positioned to face outwards from the back surface 68 to capture rider expressions during the ride. In addition, if the functional module 36 includes speakers, the speaker and/or a microphone may be positioned on the back surface 58 to be closer to the rider. In other embodiments, the opening 58 may not pass completely through the mat 16, and the back surface 68 of the functional module may abut a mat surface when positioned in the opening 58. In such embodiments, the back surface 68 may include one or more mating features that mate with complementary features on the mat 16 to facilitate coupling of the functional module 36 to the mat 16. In such an embodiment, if speakers and/or cameras are present, smaller holes or openings in the mat may align with such features to permit the camera view to include the rider.

Figure 4:
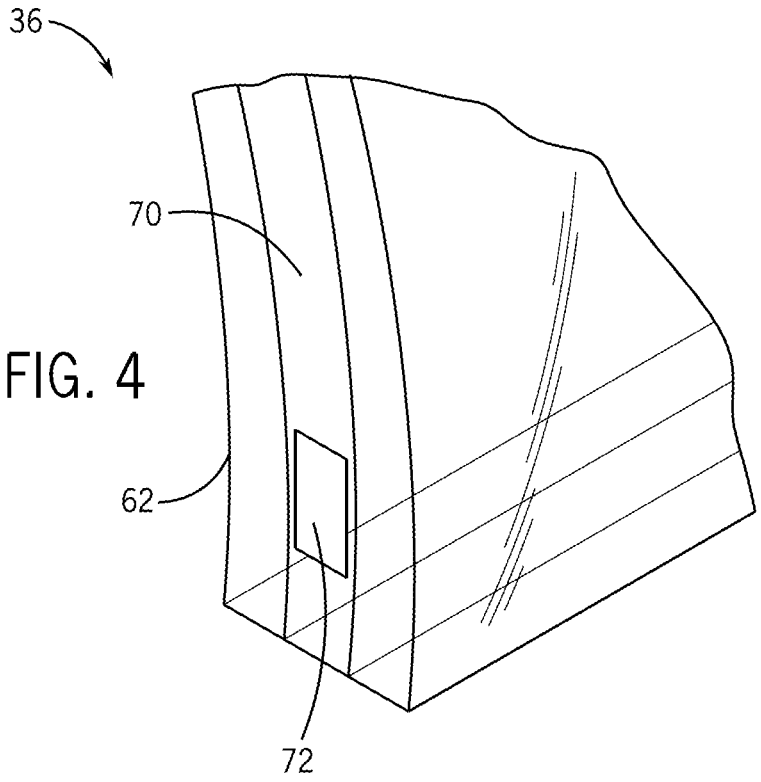
FIG. 4 is a detail view of a portion of the functional module of FIG. 3.

FIG. 4 is a detail view of the exterior 62 of the housing 54 of the functional module 36 showing a raised ridge 70 that is sized and shaped to fit into a corresponding groove in the frame 60 (see FIG. 3). In operation, the functional module 36 may be snapped into the frame 60 to ensure a secure coupling over the course of one or more rides. The functional mat racer 12 may also include additional securing features to hold the functional module 36 in place, such as securing tabs, straps, etc. In one embodiment, the functional module 36 may be removable only be a rider technician and, therefore, may include locking features to prevent decoupling by a rider. In particular embodiments, the functional module 36 may also include an electrical connector 72 that, when coupled to a corresponding feature on the frame 60, permits activation of the functional features of the functional module. In this manner, the functional module 36 may be prevented from activation during storage or when not in use.

Figure 5:
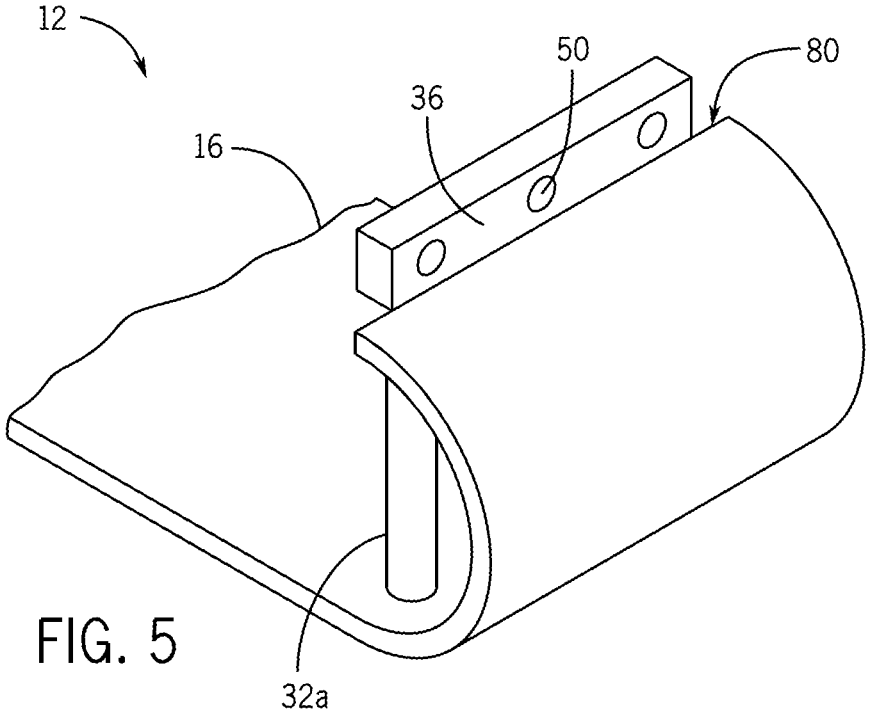
FIG. 5 is a front perspective view of a functional mat racer including a functional module integrated within a handle in accordance with present techniques.
Figure 6:
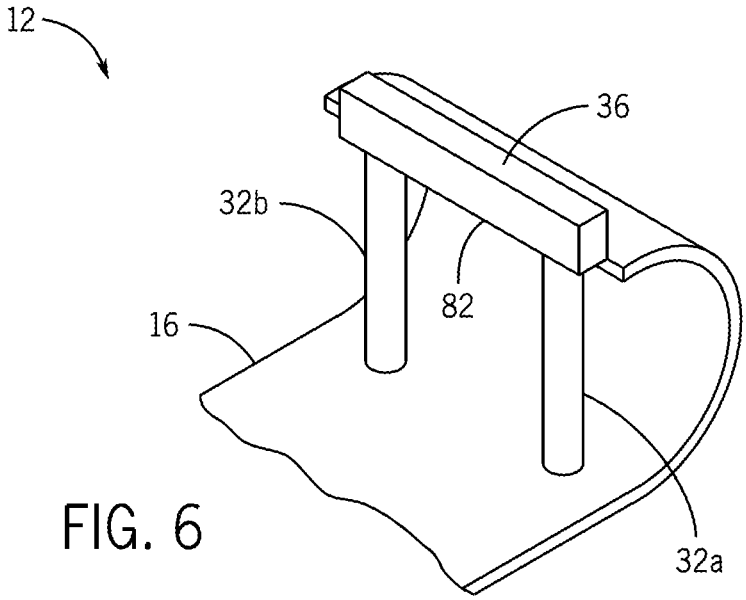
FIG. 6 is a back perspective view of the functional mat racer of FIG. 5.

FIG. 5 shows a front perspective view of an arrangement of a functional mat racer 12 including a functional module 36 integrated with the handles 32. In the depicted arrangement, the light sources 50 are positioned above a top 80 of the mat 16. As shown in a back perspective view in FIG. 6, the handles 32*a* and 32*b* and the functional module 36 may be implemented as a unitary assembly. In such an arrangement, the light sources may be part of a molded handle assembly that includes a bridge piece 82 that couples to both of the handles 32*a* and 32*b*. Other arrangements of the functional mat racer 12 are also contemplated. For example, in one embodiment, the functional mat racer 12 may include one or more translucent or clear areas integrated into the rider-supporting surface 22 so that the lights may be viewed through the bottom of the mat. In addition, the functional mat racer 12 may be implemented as a generally planar or flat mat and the functional module 36 may be positioned at or near a forward mat terminus. Further, the light sources may extend through holes in the mat 16 in some embodiments. In another embodiment, the handles 32 may include other functional features. For example, the handles 32 may include one or more heart rate sensors that function to monitor the rider's heart rate via contact with one or both of the rider's hands. The heart rate information may also be provided as an input to the light and/or sound features of the functional module 36. Accordingly, the heart rate sensor may be directly or wirelessly coupled to the functional module 36 to provide heart rate data as an input. In one example, the lights may pulse in time with the rider's own heart rate.

Figure 7:
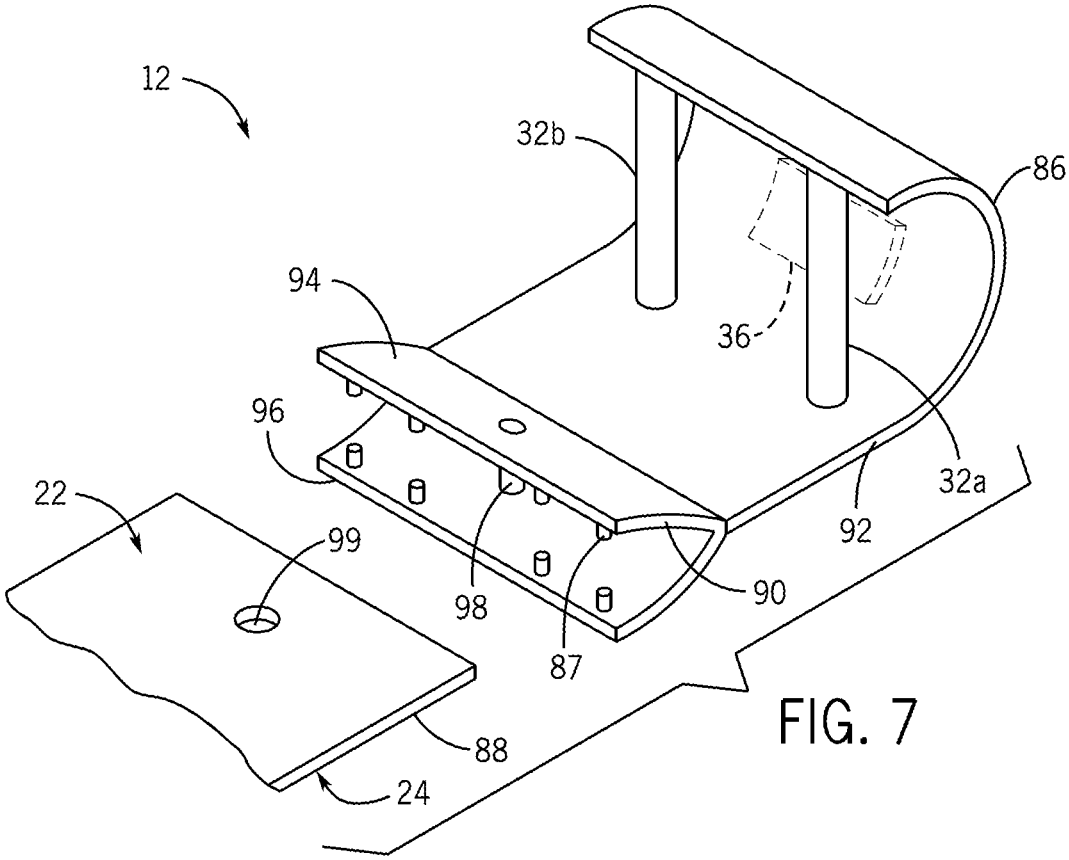
FIG. 7 is a side perspective view of a functional mat racer including a detached portion in accordance with present techniques.

FIG. 7 is a side perspective view of an embodiment of the functional mat racer 12 in which the functional portion is part of a detachable unit. For example, the functional mat racer 12 may include a front separable portion 86 that is separable from a back mat portion 88. The front separable portion 86 includes the functional module 36, the handles 32*a*,32*b*, an attachment unit 90, and a shield portion 92. The shield portion 92 may be formed from a relatively rigid material, i.e., a plastic or polymer. In certain embodiments, the shield portion 92 may be formed from a relatively flexible material. Similarly, the back mat portion 88 may be formed from a flexible or more rigid material. The front separable portion 86 may be coupled to the back mat portion 88 for use in the ride. During storage or charging, the front separable portion 86 may be separated from the back mat portion 88 to permit a smaller charging or storage unit.

The attachment unit 90 may be configured in any suitable format to couple the front separable portion 86 to the back mat portion 88. For example, the attachment unit may include a top wing 94 and a bottom wing 96 that are configured to hold the back mat portion 88 between them. To that end, the top wing 94 and the bottom wing 96 may be formed from materials that can couple to or grip the back mat portion 88. In one embodiment, the top wing 94 directly contacts the rider-supporting surface 22, and the bottom wing 96 directly contacts the opposing surface 24. When the back mat portion 88 is in place, the attachment unit 90 may include certain features to preserve the coupling. In one embodiment, the top wing 94 and the bottom wing 96 are configured to be biased towards one another to provide a spring force to grip the inserted part of the back mat portion 88. For example, the top wing 94 and the bottom wing 96 may be formed from a single bent polymer with a spring force. In another embodiment, the top wing 94 and the bottom wing 96 may be joined by a hinge. In yet another embodiment, the top wing 94 and the bottom wing 96 may be closed with snaps, straps, or other locking features. The top wing 94 and the bottom wing 96 may include gripping features 97 (e.g., teeth, etc.) to hold the back mat portion 88 in place and prevent sliding of the back mat portion 88 relative to the attachment unit 90. In addition, the attachment unit may include a rod 98 configured to mate with a passage 99 formed in the back mat portion 88. Once inserted, the rod may be locked into place such that only a ride technician may separate the top wing 94 and the bottom wing 96 to remove the rod 98 and uncouple the front separable portion 86 and the back mat portion 88.

Figure 8:
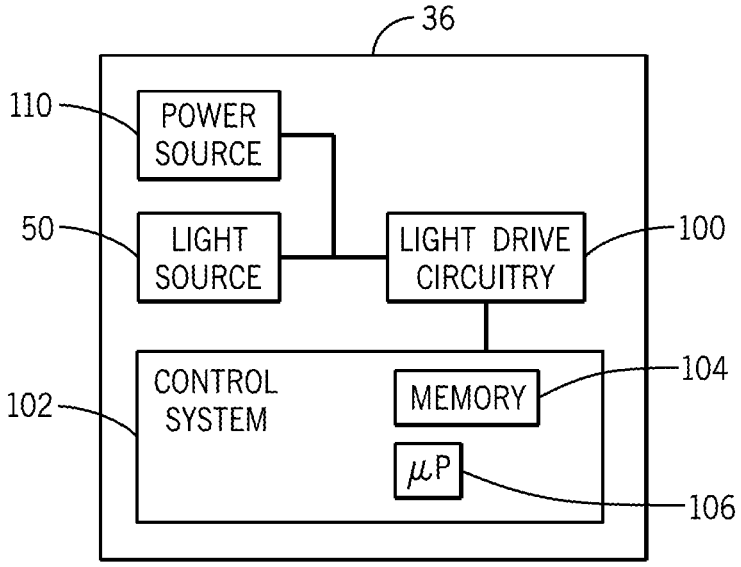
FIG. 8 is a block diagram of a functional module that may be used in conjunction with a functional mat racer in accordance with present techniques.

FIG. 8 is a block diagram of an embodiment of the functional module 36. The functional module 36 includes one or more light sources 50, which may include LEDs, light-emitting electrochemical cells, or any other suitable light source. The light sources 50 include lights that emit in one or more colors in the visible range and/or fluorescent ranges. The one or more light sources 50 may include suitable lens elements and circuitry, such as light drive circuitry 100. The light drive circuitry 100 is controlled by a control system 102, which may include a memory device 104 for storing instructions executable by a processor 106 to perform the methods and control actions described herein. The processor 106 may include one or more processing devices, and the memory 104 may include one or more tangible, non-transitory, machine-readable media. By way of example, such machine-readable media can include RAM, ROM, EPROM, EEPROM, or other optical disk storage, magnetic disk storage or other magnetic storage devices, or any other medium which can be used to carry or store desired program code in the form of machine-executable instructions or data structures and which can be accessed by the processor 106 or by any general purpose or special purpose computer or other machine with a processor. In addition, the functional module components may be powered via a power source 110. The power source 110 may be a battery (e.g., a rechargeable battery). The power source 110 may also be coupled to solar panels integrated into the mat 16 or may be configured to charge inductively. In one embodiment, the mat racer 12 may be configured to generate power via motion. For example, the mat racer 12 may include a water wheel embedded in the functional module 36 that rotates and generates power to power the electrical components of the functional module 36.

Figure 9:
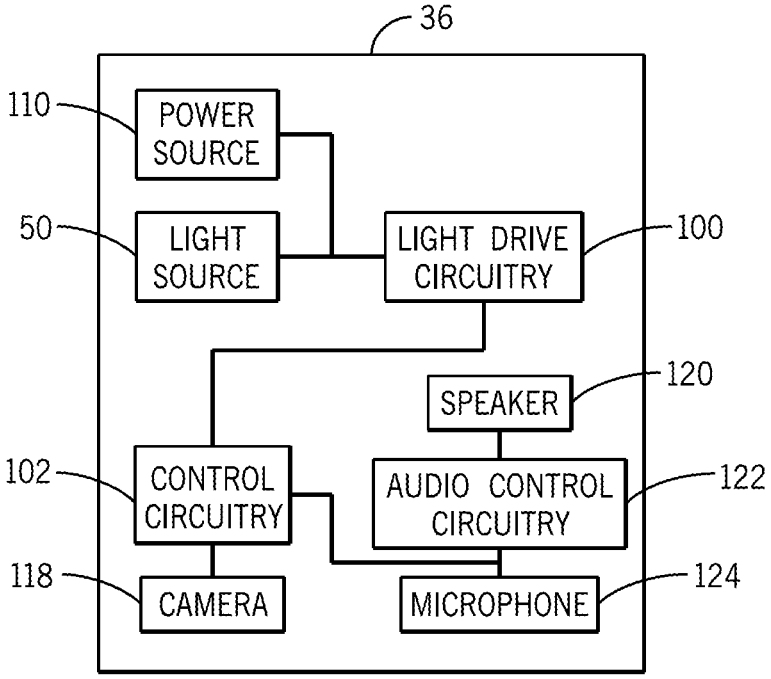
FIG. 9 is a block diagram of a functional module that may be used in conjunction with a functional mat racer in accordance with present techniques.

In addition to light functionality, the functional module 36 may include sound and/or image functionality. FIG. 9 is a block diagram of an embodiment of a multifunctional functional module, including one or more cameras 118. The camera/s may be configured to capture video or still images. Depending on the configuration of the functional module 36, the camera 118 may capture images from the rider and/or of the path of the functional mat racer 12. The captured images may be stored by the memory 104 and retrieved after the ride as an add-on to the ride experience. Alternatively or additionally, the images may be sent wirelessly to other riders or routed to display screens around the amusement park to promote the ride by showing substantially real-time images of riders or the ride. The functional module 36 may also include a speaker 120 for playing sound effects or music and associated audio control circuitry 122 as well as a microphone 124 for capturing sounds from the rider.

Figure 10:
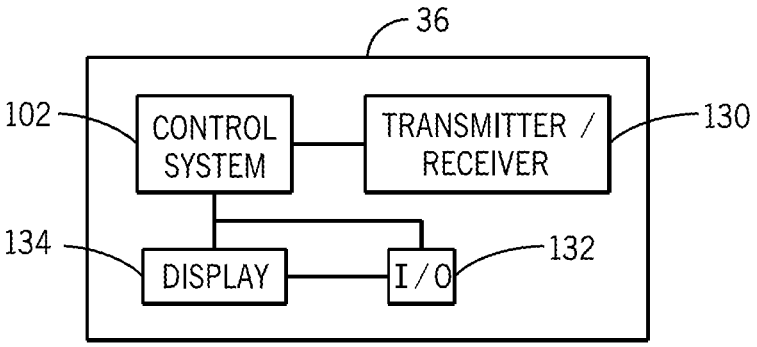
FIG. 10 is a block diagram of a functional module that may be used in conjunction with a functional mat racer in accordance with present techniques.

The functional module 36 may be configured to engage in one-way or two-way communication. FIG. 10 is a block diagram of a functional module 36 that is configured to receive input, wirelessly and/or from an operator. For example, the functional module 36 may be configured to include communication circuitry, such as a transceiver 130 to communicate over wireless communication paths. The functional module 36 may also include various components that may allow for interaction with a rider, such as one or more user input devices 132, such as a user input structure (e.g., a button or switch) or input/output interface. The functional module may also include a display 34 to display images and/or to display menu options that are selectable by the rider. For example, the rider may select a particular light pattern and/or song track for the ride. It should be understood that the depicted functional module 36 may include functional features (e.g., lights) as shown in FIGS. 8-9. For example, in one embodiment, the functional module 36 may receive information to control the lighting show from a wireless signal. The wireless signal may be associated with a particular rider. For example, the rider may select the light and/or sound show from a selection kiosk or mobile device while queuing for the ride. The rider may then swipe a reader or otherwise associate a particular mat racer 12 and its corresponding functional module 36 with their rider information to initiate the download of the wireless signal including the information controlling the light/sound show to the functional module 36. In one example, the functional module 36 may include no light and/or sound or only limited light and/or sound information retained in its on-board memory, such as a default light and/or sound show, and may receive the selected information wirelessly, which in turn is stored in temporary memory during the course of the ride, and may be erased or written over with each new rider. In certain embodiments, the information is streamed such that the functional module 36 receives a ride initiation signal to turn on, then receives the light and/or sound information via a wireless signal, and subsequently receives a stop/off signal. In a real-time streaming example, the riders or other guests (e.g. VIP guests or queuing guests) may control the light or sound effects for riders within the ride in real-time. Such an experience may be enjoyable for friends or family groups.

Figure 11:
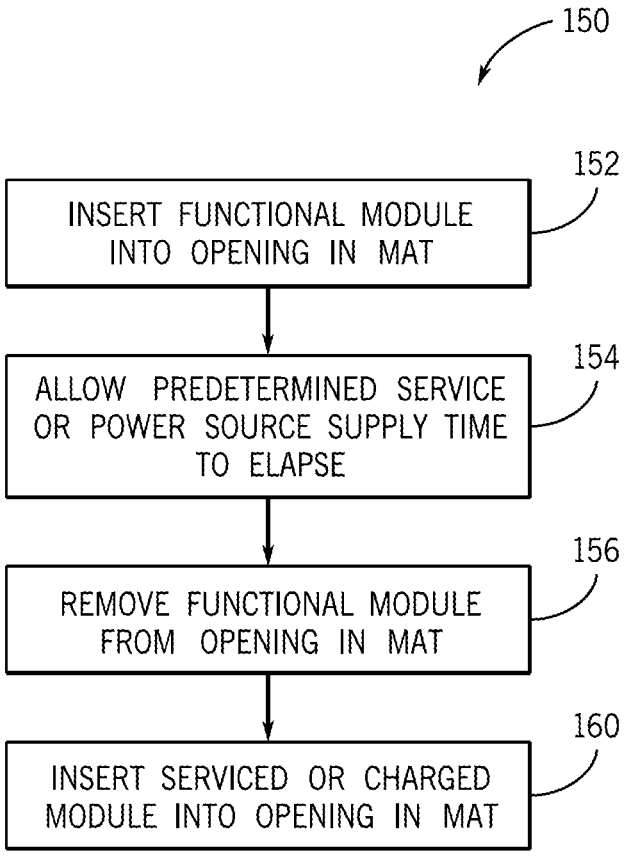
FIG. 11 is a flow diagram of a method for changing modules for a functional mat racer in accordance with present techniques.

FIG. 11 is a flow diagram of method 150 of swapping out functional modules 36 from a functional mat racer 12 for charging or service. The method 150 may be performed in conjunction with functional mat racers 12 with removable functional modules 36. The functional module 36 is inserted into an opening in the mat 16 (e.g., opening 58, see FIG. 3) to couple the functional module 36 to the body of the mat 16 (block 152). The functional mat racer 12 including the functional module 36 is then operated as provided herein. For example, the functional mat racer 12 is used on multiple rides over a period of time until a predetermined service time or power supply time has elapsed (block 154). In one embodiment, the functional module 36 is scheduled to be serviced at regular intervals, e.g., once every three months. In another embodiment, a power supply of the functional module 36 has a known battery life before needing to be recharged. The functional module 36 may be configured to provide an indication that service is needed or that the battery charge is low. For example, such indications may be provided as text messages or icons on a display screen and may be triggered by expiration of a timer set to the predetermined service or power supply time. When the functional module 36 is scheduled to be recharged or serviced, the functional module 36 is removed from the body of the mat 16 (block 156) and a serviced or charged functional module 36 is then coupled to the mat 16 (block 160) in its place. The charging may be solar, inductive, plug-in, etc. In this manner, functional modules 36 may be swapped out or interchanged to keep a fully operational and/or charged functional module 36 in place for each rider.

In certain embodiments, the functional modules 36 may also be interchanged to change their functionality. For example, an individual functional module 36 without audio functionality may be exchanged for one with audio functionality as a ride is upgraded. In another embodiment, a ride may go into night or holiday mode and may use special functional modules 36 with themed light colors and/or patterns. For example, a functional module 36 with red and green lights may be used during the Christmas season or a functional module 36 with a black light (i.e., an ultraviolet light) may be used during special ride runs to illuminate fluorescent materials on the surfaces of the ride, in the water, on the functional mat racers 12, or on the riders themselves. While the functionality of the functional module 36 may be altered by physically changing or swapping modules to achieve the desired functionality, the functional module 36 may also be multifunctional and capable of operating in different modes.

Figure 12:
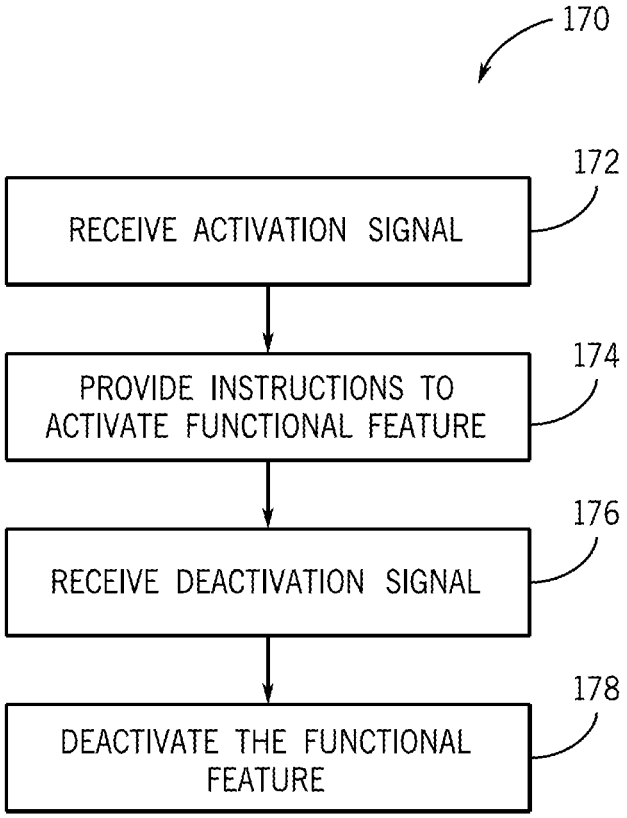
FIG. 12 is a flow diagram of a method for operating modules for a functional mat racer in accordance with present techniques.

In operation, a rider at the ride entry point (e.g., at the top of a ride flume) mounts the functional mat racer 12 and then proceeds through the ride while the functional components of the functional module 36 provide ride-enhancing effects. FIG. 12 is a flow diagram of a method 170 of activation of the functional module 36 in conjunction with the ride. The functional module 36 receives an activation signal (block 172), which may be a via a user input. For example, the activation signal may be triggered by actuation of a user input device (e.g., a button or switch) positioned on the functional module 36 at a location easily-accessible by the rider when rider mounts the functional mat racer 12 at the start of the ride. In one embodiment, a ride operator may activate the functional module 36 when providing the functional mat racer 36 to the rider. Further, the functional features may be configured to start after a certain amount of time has elapsed after activation to account for any delay in receiving functional mat racer 12 and ascending to the start of the ride.

It may be advantageous to provide passive activation to prevent certain riders from inadvertently forgetting to activate the functional module 36 or to prevent activation that may misalign the light, image, and/or sound effects of functional module 36 with the appropriate elements of the ride. To that end, the activation signal may be in the form of a wireless activation signal received by the functional module 36. For example, the activation may be a radiofrequency signal emitted by a device positioned at the top of a ride or emitted by a park identification bracelet worn by each rider. The activation signal may also be triggered by a sensor output. For example a sensor positioned on the functional mat racer 12 may be an optical, temperature, chemical, pressure, or other sensor type that is triggered at the ride start. In one embodiment, a pressure sensor may sense the weight of a rider 20 on the functional mat racer to trigger the activation signal.

Once the activation signal is received by the functional module 36, the functional module 36 activates the appropriate functions (block 174). For example, for a relatively simple device that only includes light effects, the activation signal drives the activation of the light sources 50. Additionally or alternatively, the activation signal may drive the activation of music or sound effects. Further, the activation signal may activate image displays and/or camera functionality. In a specific embodiment, the activation signal causes the control system (e.g., control system 102) of the functional module 36 to drive a light drive to activate one or more light sources 50. In another embodiment, the activation signal causes the control system to access one of a plurality of possible instructions from the memory (e.g., memory 104) to be executed by the processor (e.g., processor 106). For example, a rider may select a "holiday" or "winter" mode from a menu or selection input, which would result in the selection of associated instructions that would then activate a pattern of red and green lights. In another embodiment, the light effects may be associated with particular ride themes. For example, a rider may select themes associated with particular sports teams or superheroes, which in turn may be associated with particular colors or moods. The instructions may include light drive signals for each light source 50, including instructions for active periods for each individual light source and inactive or dark periods.

Depending on the number of light sources 50, the resultant possible light patterns over a given ride length may be relatively complex. Further, while each light source 50 may emit light in a given wavelength band associated with a single color, the light sources 50 may also be tuned to a range of colors. Accordingly, the instructions may also include light tuning instructions. Depending on the particular pattern selected, the light effects may be relatively upbeat in certain modes or soothing and peaceful in other modes. It should be understood that the received signal may also be a passive signal, and the control system for the ride may select the light pattern based on a time of day (e.g., selecting between light effects that are more visible during the day vs. night) and provide the selection information in a wireless signal received by the functional module 36.

As noted, the activation signal may also include information about selected music effects. In one embodiment, a rider may select among certain music tracks for the ride, which are automatically associated with light effects that complement the music. The selection may be input via a display screen on the functional module 36 or may be selected at a ride kiosk or terminal while the rider is waiting for the ride. The information may then be associated with a rider's park identification bracelet. When the bracelet is read by a reader at the start of the ride, the information is then transmitted to the functional module 36. The transmitted information may also include the selected audio file or data. Alternatively or additionally, the functional module 36 may store a library of audio files, including music data and associated instructions for matched light effects. For example, an upbeat or fast music track may have a light pattern that is matched to the beat of the music. The track may also be passively determined (e.g., without user input) based on the time of day, time of year, or the color of the mat 16. In a similar manner, the functional module 36 may also receive signals related to camera or display functionality. The available light and/or sound patterns may be timed to align with various features of the ride itself. For example, the lights may flash during curves in a slide or the lights may go ultraviolet in an area of the slide coated with fluorescent paint.

To turn off the functional components for storage of the functional module 36 in an inactive mode, the functional module 36 may also receive a deactivation signal (block 176) that triggers deactivation of the active functional components (block 178). For example, the deactivation signal may trigger deactivation of the light sources 50. In one embodiment, the deactivation signal is provided upon expiration of a timer that is set to an average run time for the ride. In another embodiment, the deactivation signal is transmitted wirelessly to a receiver (e.g., receiver 130). In yet another embodiment, the deactivation signal may be triggered by actuation of a user input structure, such as an on/off button. After the ride is complete, the rider returns the functional mat racer 12 to a storage facility, where the functional module 36 may be stored in a charging station. In one embodiment, the charging station may be an inductive charging station. In another embodiment, the power source (e.g., power source 110) may be modular and capable of being removed from the functional module 36 for separate storage and charging.

Figure 13:
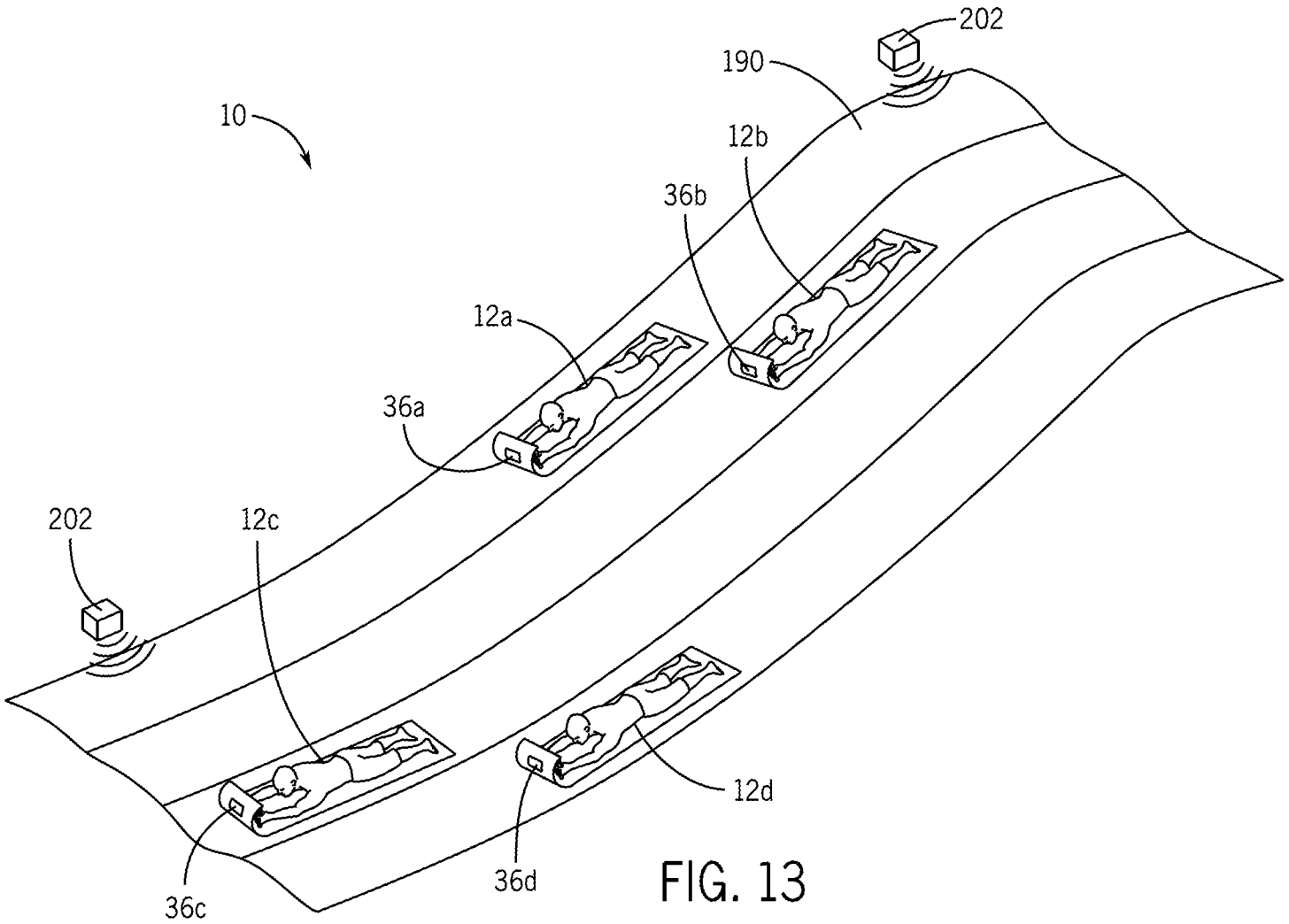
FIG. 13 is a perspective view of a multi-lane water slide racing ride using functional mat racers in accordance with present techniques.

A water ride may be implemented with multiple lanes to accommodate multiple riders on respective functional mat racers 12 on the ride over the same time period. FIG. 13 is a perspective view of a water ride system 10 including multiple lanes 190. The water ride system 10 also includes a transceiver 200 configured to communicate with the functional mat racers 12 (e.g., functional mat racers 12*a*, 12*b*, 12*c*, and 12*d*). The transceiver 200 may communicate in a one-way manner to transmit an activation signal to turn on the functional modules 36 (e.g., functional modules 36*a*, 36*b*,36*c*, and 36*d*). In another embodiment, the communication may be in the form of a handshake, and each individual functional module 36 may provide identification information to the transceiver 200. The activation signal may be encoded based on the identification information and any rider-specific functional selections. The water ride system 10 may include additional sensors and transceivers along the course to provide additional instructions, including a terminal transceiver 202 to provide a deactivation signal. In one embodiment in which the water slide is implemented as a race, the functional mat racer 12*c* positioned in first place may emit a blue light while the functional mat racer 12*d* in second place emits a red light, etc. In this manner, the functional mat racers 12 provide feedback to their riders over the course of the ride. In another embodiment, the activation signals may include instructions to switch all riders to blue lights, then red lights, then green lights at the same time, regardless of their position on the ride.

While only certain features of the invention have been illustrated and described herein, many modifications and changes will occur to those skilled in the art. It is, therefore, to be understood that the appended claims are intended to cover all such modifications and changes as fall within the true spirit of the invention. While certain disclosed embodiments have been disclosed in the context of amusement or theme parks, it should be understood that certain embodiments may also relate to other uses. Further, it should be understood that certain elements of the disclosed embodiments may be combined or exchanged with one another.

The invention claimed is:

1. A mat racer, comprising:

a mat configured to accommodate a rider, wherein the mat comprises a rider surface configured to support the rider and an opposing surface configured to contact a ride floor or slide surface;

one or more handles coupled to the mat; and a functional module disposed on the mat, wherein the functional module comprises:

one or more light sources that are positioned on or in the functional module;

a light drive configured to drive the one or more light sources;

a memory storing instructions to control the light drive;

a processor configured to execute the instructions based on control information; and a transceiver configured to receive a wireless signal from a controller, wherein the wireless signal comprises the control information for the one or more light sources and wherein the control information is based on input from the rider to the controller and wherein the transceiver is configured to receive the control information based on an association of the mat racer with the rider.

2. The mat racer of claim 1, wherein the functional module is removable from the mat racer.

3. The mat racer of claim 1, wherein the mat comprises an opening or receptacle configured to receive the functional module.

4. The mat racer of claim 1, wherein the functional module is waterproof.

5. The mat racer of claim 1, wherein the mat is partially folded or bent such that an end of the mat is raised relative to an interior portion of the mat.

6. The mat racer of claim 5, wherein the functional module is positioned on the mat in a location between the end and the interior portion of the mat such that the functional module is raised relative to the interior portion.

7. The mat racer of claim 1 wherein the functional module comprises one or more of a speaker, an audio recorder, or a camera.

8. The mat racer of claim 1, wherein the one or more light sources are sealed within a housing.

9. The mat racer of claim 1, wherein the one or more light sources are positioned in or on the functional module such that, when turned on, the one or more light sources shine towards the opposing surface.

10. The mat racer of claim 1, wherein the one or more light sources comprise a plurality of light sources, each light source of the plurality of light sources being a different color.

11. The mat racer of claim 1, wherein the one or more light sources comprise color-changing or tunable light sources.

12. The mat racer of claim 1, wherein the functional module comprises a rechargeable power source coupled to the one or more light sources.

13. A mat racer, comprising:

a mat configured to accommodate a rider, wherein the mat comprises a rider surface configured to support the rider and an opposing surface configured to contact a ride floor or slide surface;

one or more handles coupled to the mat; and a functional module disposed on the mat, wherein the functional module comprises one or more light sources that are positioned on or in the functional module, wherein the functional module comprises:

a light drive configured to drive the one or more light sources;

a transceiver configured to communicate with a wearable device worn by the rider to receive information associated with the wearable device;

a memory storing instructions to control the light drive; and a processor configured to execute the instructions, wherein the instructions comprise instructions to activate the one or more light sources based at least in part on the information associated with the wearable device.

14. The mat racer of claim 13, wherein the functional module is configured to receive a user input and wherein the processor executes the instructions based on the user input.

15. The mat racer of claim 14, wherein the processor ceases execution of the instructions based on a second user input, and wherein ceasing the instructions deactivates the one or more light sources.

16. The mat racer of claim 13, wherein the processor ceases execution of the instructions based on a stop signal received by the transceiver, and wherein ceasing the instructions deactivates the one or more light sources.

17. The mat racer of claim 13, wherein the processor ceases execution of the instructions based on an expiration of a timer, and wherein ceasing the instructions deactivates the one or more light sources.

18. The mat racer of claim 17, wherein the timer is set for a length of time corresponding to an average ride run time.

19. The mat racer of claim 13, wherein the instructions comprise first instructions to drive the one or more light sources in a first light pattern and second instructions to drive the one or more light sources in a second light pattern.

20. The mat racer of claim 19, wherein the processor executes the first instructions or the second instructions based on a signal received by the transceiver.

21. The mat racer of claim 19, wherein the one or more light sources comprise a plurality of light sources and wherein the first light pattern comprises activation of individual light sources of the plurality of light sources in a first order and wherein the second light pattern comprises activation of individual light sources of the plurality of light sources in a second order.

22. The mat racer of claim 13, wherein the functional module comprises a speaker configured to play audio data.

23. The mat racer of claim 22, wherein the memory stores the audio data in one or more audio files.

24. The mat racer of claim 23, wherein the audio files are selectable by a user.

25. The mat racer of claim 22, wherein the transceiver is configured to wirelessly receive the audio data.

26. The mat racer of claim 22, wherein the speaker is configured to capture audio data from the rider and store the audio data from the rider in the memory.

27. The mat racer of claim 13, wherein the one or more handles comprises a heart rate sensor, and wherein the instructions to control the light drive are responsive to an input from the heart rate sensor.

28. The mat racer of claim 27, wherein the one or more light sources are configured to pulse at a rate related to a heart rate of the rider.

29. The mat racer of claim 13, wherein the one or more light sources comprise ultraviolet light sources and wherein the instructions to drive the ultraviolet light sources are based on an estimated time that is associated with a fluorescent effect on the ride floor.

30. The mat racer of claim 26, wherein the memory stores instructions to communicate the audio data from the rider to other mat racers via the transceiver.

31. The mat racer of claim 13, wherein the wearable device comprises a radiofrequency signal emitter and wherein the information associated with the wearable device is configured to be received from the radiofrequency signal emitter.

* * * * *